United States Patent [19]

Hennisse et al.

[11] 4,161,806

[45] Jul. 24, 1979

[54] SNAP FASTENER

[75] Inventors: Bonnie C. Hennisse, Miami, Fla.; Synde Cousins, New York, N.Y.

[73] Assignee: Bonnie Enterprises, Inc., New York, N.Y.

[21] Appl. No.: 780,593

[22] Filed: Mar. 24, 1977

[51] Int. Cl.[2] ..... A44B 17/00

[52] U.S. Cl. ..... 24/201 A; 24/206 R; 24/204; 24/208 A

[58] Field of Search ..... 24/201 A, 230 BC, 201 HH, 24/208 A; 403/381; 16/DIG.13

[56] References Cited

U.S. PATENT DOCUMENTS

| | | | |
|---|---|---|---|
| 302,421 | 7/1884 | Mosier | 24/230 BC |
| 1,704,422 | 3/1929 | Belunes | 24/201 A |
| 3,052,005 | 9/1962 | Wilson | 24/230 BC |
| 4,008,513 | 2/1977 | Griffiths | 24/201 A |
| 4,052,774 | 10/1977 | Noda | 24/201 A |

FOREIGN PATENT DOCUMENTS

| | | | |
|---|---|---|---|
| 2533565 | 4/1976 | Fed. Rep. of Germany | 24/201 A |
| 1125255 | 8/1968 | United Kingdom | 24/201 A |

*Primary Examiner*—Bernard A. Gelak
*Attorney, Agent, or Firm*—David S. Woronoff

[57] ABSTRACT

A class of snap fasteners is described each of which includes at least one male and at least one female member. The female members have at least one socket portion which may be in the nature of a cavity in a hollow housing accessible by a fenestration in a face wall which is normally exposed or accessible, or may be in the nature of a through-hole in a substantially solid elongate bar member. The male members have at least one insert portion configurated and dimensioned to be receivable within an associated socket portion with relatively little clearance. Retainers are provided which limit free movement of the insert portions into and out of the socket portions. In the preferred embodiment, the retainers are in the nature of at least one protuberance or nipple at the fenestration or access opening to the socket portion which forms a local constriction of the fenestration area to provide an interference fit when the insert portion passes through the fenestration. By making either one of the portions or the retainers out of a resilient material, the insert portions can be snapped into engagement with the associated socket portions while maintaining the male and female members in substantially parallel planes throughout the joining operation. Other protuberances may be provided to improve the snap connection as well as to positionally stabilize the members once joined. The male and female members are provided with suitable connecting means for attachment to the parts to be releasably joined by the snap fastener, and are adapted to be gripped to permit the members to be separated without applying excessive stresses to the parts to be joined.

38 Claims, 20 Drawing Figures

FIG. 14
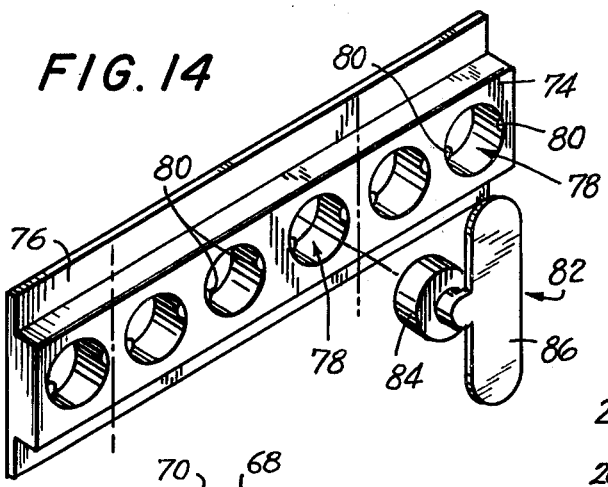
FIG. 11
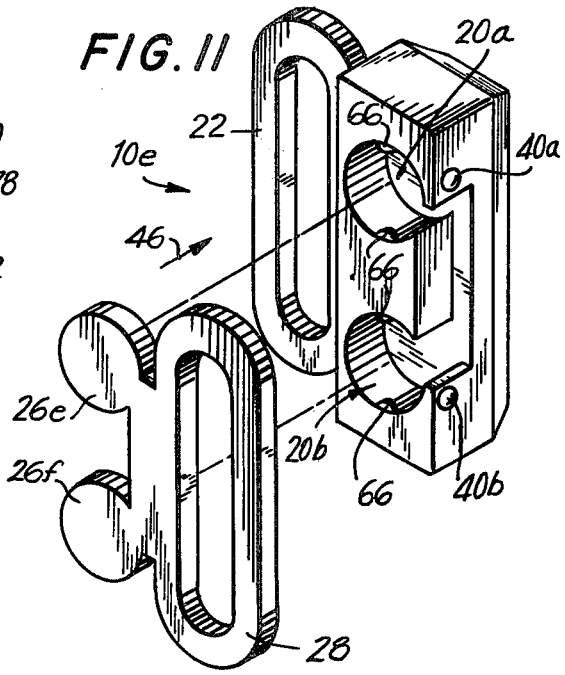
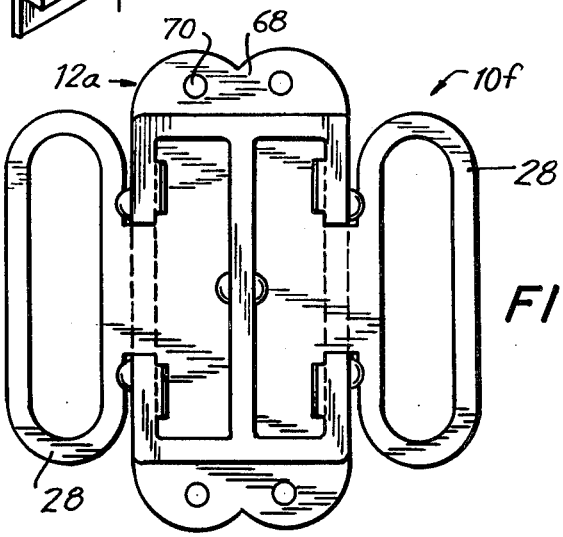
FIG. 12
FIG. 15
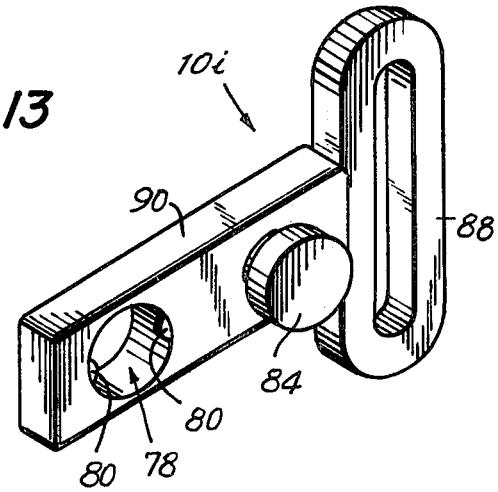
FIG. 13
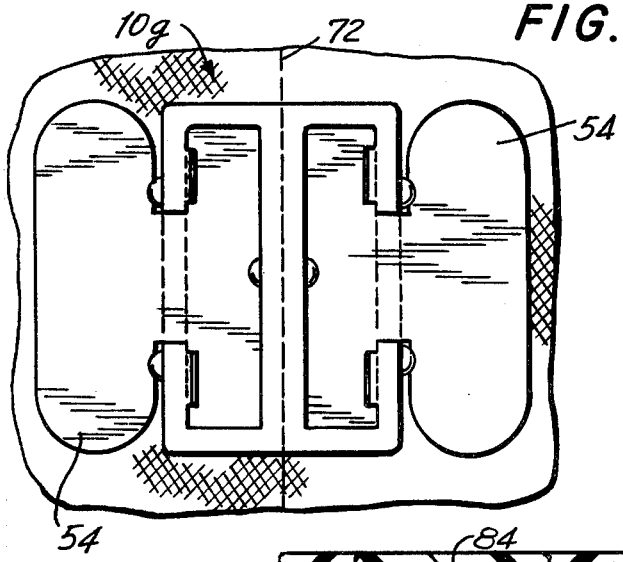
FIG. 16
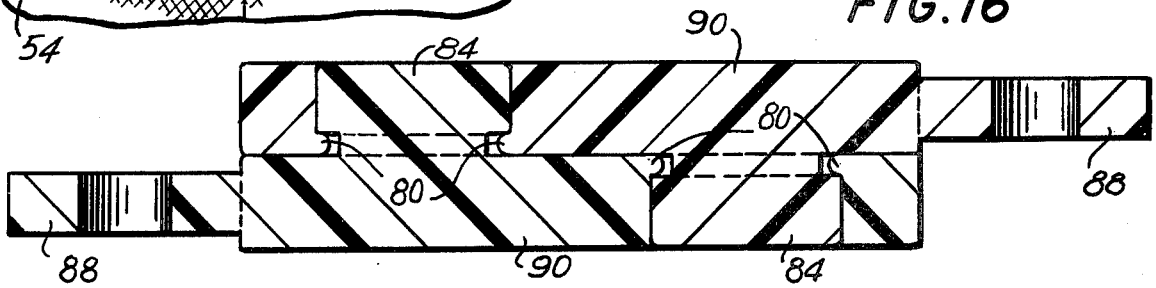

SNAP FASTENER

BACKGROUND OF THE INVENTION

This invention generally relates to fasteners, and more specifically to snap fasteners or clasps adapted to releasably join two associated parts to each other.

Various snap fasteners are known in the prior art. Such fasteners take various shapes and forms, and each different fastener is generally particularly suitable for particular applications. One of the most common types of fasteners is the snap or button-type fasteners such as the type disclosed in U.S. Pat. No. 1,904,122, which is a fastener adapted to be used on garments or articles intended to be laundered. In this patent, a stud is permanently attached to one part of a garment and a ring eyelet or grommet is permanently attached to another part of the garment. Another member is inserted into the grommet in the manner of a stud, and when there assembled it serves as a socket to detachably receive the stud and hold the separate parts of the garment together. This and numerous other similar fasteners are in common use. However, such fasteners are generally small in size and do not provide suitable gripping means, the portions of the fastener bearing the stud and socket being attached directly to the fabric or material comprising the garment. Accordingly, while it is relatively simple to join the separate parts of the fastener, separation thereof requires gripping the garment fabric and application of sometimes extensive stresses to the fabric to effectuate separation. Such extensive stresses may in time tear portions of the garment to which the fasteners are attached.

Another form of fastener or clasp is described in U.S. Pat. No. 2,765,471 which is adapted to be used with a brassiere of the type which opens in the front and is provided with breast-supporting cups. The cups are normally linked together with the clasp. The clasp includes a female member having a socket portion into which a head of a male member is receivable. However, to join the male and female members, the head must be inserted into the fenestration while rotated out of the plane of the female member. After the head has been inserted through the fenestration, it is rotated back into the plane of the female member and the head is socketed within the fenestration by means of suitable shoulders. While such a clasp is useful for brassieres which open in the front and the like, it is in some instances inconvenient to use, particularly when the fastener is used in the back of the wearer or in some other location which is difficult or inconvenient to reach.

Partially to overcome the above problems, there has been devised separable fasteners, of the type generally disclosed in U.S. Pat. Nos. 3,200,464 and 3,798,711 which include male and female connector portions which are joined by slidingly inserting the male member through a fenestration in the female member, while these members are maintained substantially in a common plane throughout the joining operation. Such fasteners are universally applicable, and may be used to join adjacent areas or edges of an item of clothing, jewelry, drapery or equipment requiring the joining of separable parts or edges. This type of fastener includes a resilient tongue or latch member which is formed on the male member for deflection during insertion into the female member, and subsequent snapping back to the original position once disposed within the female member. Suitable shoulders or abutting surfaces then maintain the male and female members locked to each other until such time that the resilient tongue member is manually depressed to release or separate the abutting surfaces. While the separable fasteners of the type just described serve well in most applications, they have the drawback that there is a movable or deflectable member which may, for various reasons, cease to function properly or actually break off from the male member. In either case, the fastener members may be subject to inadvertent separation. Additionally, where the resilient tongue member protrudes or is beyond the confines of the female member during engagement therewith, it may inadvertently be depressed to cause undesirable separation of the members from each other. Excessive longitudinal forces on the male and female members tending to separate the same may also be sufficient to deflect the resilient tongue member and thereby disengage the abutting or engaging locking surfaces. Since the operation of the fastener is dependent upon the resilient tongue member, a separable fastener tends to be, under certain circumstances, positionally unstable and may cause separation of the parts or items which have been fastened together to the inconvenience and discomfort of the user. Such positional instability limits, to some extent, the longitudinal or pulling forces which can be applied in opposite directions on the male and female members.

SUMMARY OF THE INVENTION

It is an object of the present invention to provide a snap fastener which overcomes the above described disadvantages associated with prior art fasteners.

It is another object of the present invention to provide a snap fastener which is simple in construction and economical to manufacture.

It is still another object of the present invention to provide a snap fastener which includes male and female members which may be maintained in substantially parallel planes during snapping and unsnapping of the same.

It is yet another object of the present invention to provide a snap fastener wherein the male and female members are substantially coplanar during engagement so as to provide a relatively smooth or flat surface abutting against the wearer to make the fastener more comfortable and less irritating during use.

It is a further object of the present invention to provide a snap fastener which may be provided with various connecting means to make the same adaptable for use in many applications.

It is still a further object of the present invention to provide a snap fastener which provides positional stability during engagement which prevents the fastener parts from becoming inadvertently separated upon application of longitudinal outward or pulling forces.

It is yet a further object of the present invention to provide a snap fastener which is simple and convenient to use substantially independently of where or on what part of the body the fastener is used or how inconvenient its location may be to reach.

It is an additional object of the present invention to provide a snap fastener of the type generally under consideration which includes means for aligning the male and female members thereof to facilitate engagement therebetween.

It is still an additional object of the present invention to provide a snap fastener which is made from one universal member which includes both socket and insert portions, so that a snap fastener may be formed by use of two such universal members.

It is yet an additional object of the present invention to provide a snap fastener which includes a female member having a plurality of insert or socket portions spaced from each other substantially along a straight line, and a male member having an insert portion which is releasably and snappingly selectably receivable into any one of the socket portions, to permit the parts or members which are to be joined to be connected at different relative positions to each other, and being suitable for use with curtain rod assemblies for adjusting the relative position of a curtain with respect to the curtain rod to thereby insure that the top or bottom edges of the curtain are at the desired levels.

It is another object of the present invention to provide a snap fastener having a single female member provided with two socket portions, and two separate male members each having one insert portion receivable into an associated socket portion, which snap fastener is particularly suitable for use with brassieres used for breast feeding, wherein each cup may be separately disconnected from a central brassiere strip or member to which the female fastener member is connected, and moved outwardly to the side of the wearer.

The above objects, as well as others which will become evident hereafter, are achieved in accordance with the present invention by providing a fastener for releasably joining two associated parts to each other which includes a female member having a first connecting means for connecting the female member to one of the asociated parts. The female member has a socket portion. A male member is provided having a second connecting means for connecting the same to the other one of the associated parts having an insert portion. The insert portion is dimensioned and configurated to be removably receivable within the socket portion with little relative clearance. The first and second connecting means are securely attached to the respective ones of the portions and are adapted to be gripped to disengage the portions without applying excessive stresses to the associated parts. At least one of the portions is provided with retaining means for releasably retaining the other of the portions during engagement therebetween. The insert portion is snappingly receivable into the socket portion by deforming at least one of said portions and said retaining means.

In the presently preferred embodiment, the socket portion is in the nature of a cavity in a hollow housing accessible by means of a fenestration in a face wall which is normally exposed, or may be in the nature of a through hole in a substantially solid elongate bar member. The retaining means is provided on one of the portions for limiting free movement of the insert portions into and out of the socket portions. In the preferred embodiments, the retaining means are in the nature of at least one protuberance or nipple at the fenestration or access opening to the socket portions to provide a local constriction of the fenestration area to provide an interference fit when the insert portion passes through the fenestration. By making either one of the portions or the retainers out of a resilient material, the insert portions can be snapped into engagement with the associated socket portions while maintaining the portions in substantially parallel planes throughout the joining operation. Other protuberances are advantageously provided to improve the connection and to stabilize the portions once joined.

BRIEF DESCRIPTION OF THE DRAWINGS

Further advantages of the invention will become apparent from the reading of the following specification described in illustrative embodiments of the invention. The specification is to be taken with the accompanying drawings in which:

FIG. 11 is generally similar to the embodiment shown in FIG. 10, except that the connecting means take the form of loops or eyelets, and the insert portions are generally circular instead of rectangular;

FIG. 12 is a further embodiment of the present invention, generally similar to the embodiment shown in FIGS. 1–5, but utilizing a single female member having two separate or distinct socket portions, and two separate male members each provided with its own connecting means, and having an insert portion receivable within an associated socket portion of the female member;

FIG. 13 is generally similar to the embodiment shown in FIG. 12, except that instead of providing the female member with a flat sewing tab of the type shown in FIG. 12, the housing of the female member of the embodiment shown in FIG. 13 is sewn directly to the item on which it is mounted or otherwise joined by any suitable means, and the male member connecting means are in the nature of flat sewing tabs in place of the loops or eyelets;

FIG. 14 is yet a further embodiment of the present invention and illustrates in perspective a generally elongate female member provided with a plurality of spaced socket portions in the nature of through holes, and a male member having an insert portion snappingly receivable in any one of the socket portions to provide adjustability of the relative positions of the parts to be attached on which the male and female members are mounted;

FIG. 15 is an additional embodiment of the present invention, wherein a single universal member includes both socket and insert portions;

FIG. 16 is a longitudinal cross-section through a snap fastener composed of two universal members of the type shown in FIG. 15 engaged with one another;

DESCRIPTION OF THE PREFERRED EMBODIMENTS

Figure 1:
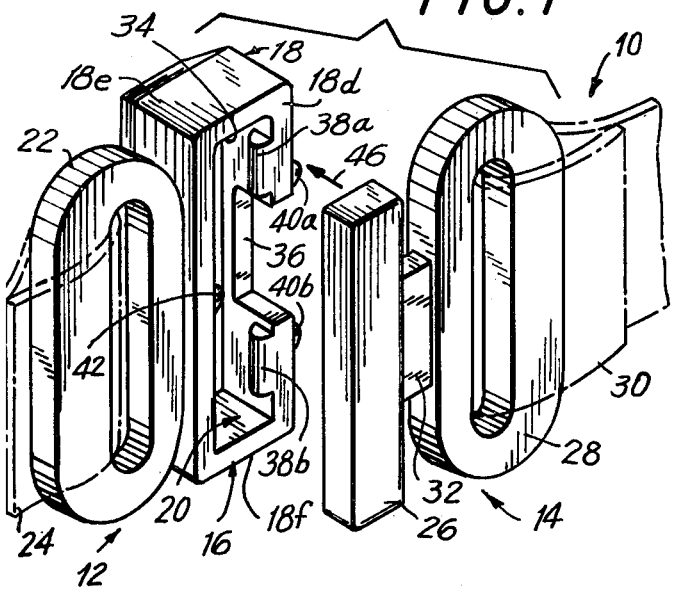
FIG. 1 is an exploded perspective view of a snap fastener in accordance with the present invention, showing the male and female members joined to associated parts to be connected, and showing the general orientations of the male and female fastener members in generally parallel planes, and the relative movements of the fastener members along a direction generally normal to the parallel planes to effect snapping engagement therebetween.

Referring now more specifically to the FIGS., in which identical or similar parts are designated by the same reference numerals throughout, and first referring to FIGS. 1–5, there is shown a snap fastener or clasp in accordance with the present invention which is generally designated by the reference numeral 10.

The fastener 10 shares the same or similar structural features with the other embodiments to be described below in that the fastener 10 includes a female member 12 and a male member 14. The female members of each of the embodiments have at least one socket portion which may be in the nature of a cavity in a hollow housing accessible by a fenestration in a face wall which is normally exposed. Alternately, the socket portion may be in the nature of a through hole in a substantially solid elongate bar member. The male members of all of the embodiments have at least one insert portion configurated and dimensioned to be receivable and an associated socket portion with relatively little clearance. Retainers are provided on the portions which limits free movement of the insert portions into and out of the socket portions. The retainers are in the nature of at least one protuberance or nipple at a fenestration or access opening to the socket portion to provide a local constriction of the fenestration area to provide an interference fit when the insert portion passes through the fenestration. By making either one of the portions or the retainers out of a resilient material, the insert portions can be snapped into engagement with the associated socket portions while maintaining the portions or fastener members in substantially parallel planes throughout the joining operation. More than one retainer protuberance is advantageously provided to improve the snap connection and to stabilize the portions once joined. The male and female members are provided with suitable connecting means for attachment to the parts to be releasably joined by the snap fastener, the connecting means being adapted to be gripped to permit the fastener member to be separated without applying excessive stresses to the parts to which they are connected.

Referring to FIGS. 1–5, the female member 12 has a socket portion in the nature of a cavity formed in the hollow housing 18. The hollow housing 18 has a face wall 18*a* which for purposes of this application is defined as the wall which is normally accessible or exposed, and a rear wall 18*b* opposite the face wall. The housing 18 also includes side walls 18*c* and 18*d*, as well as top and bottom walls 18*e* and 18*f*. The cavity 20 is formed by the aforementioned walls and is accessible to the exterior at the face wall 18*a*, as to be described. The internal space or volume of the fastener 10 is shown generally rectangular.

Suitable connecting means, such as the loop or eyelet 22 is joined to the housing 18 at the side wall 18*c* by any suitable means as shown. Advantageously, the female member 12 is integrally formed, such as by injection molding, and is made from a resilient or yieldable material, such as plastic. The loop or eyelet 22 is in and of itself conventional and may be used to attach the female member 12 to one of two associated parts 24, such as a belt or brassiere strap.

Figure 4:
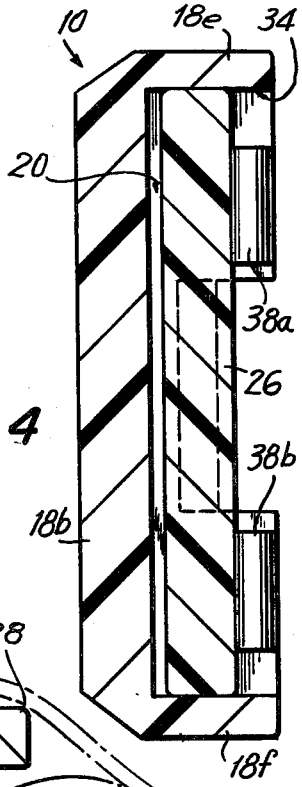
FIG. 4 is an enlarged cross-sectional view of the snap fastener shown in FIG. 2, taken along line 4—4, and showing the insert portion or tab of the male member received within the socket portion or cavity of the female member with relatively little clearance.
Figure 5:
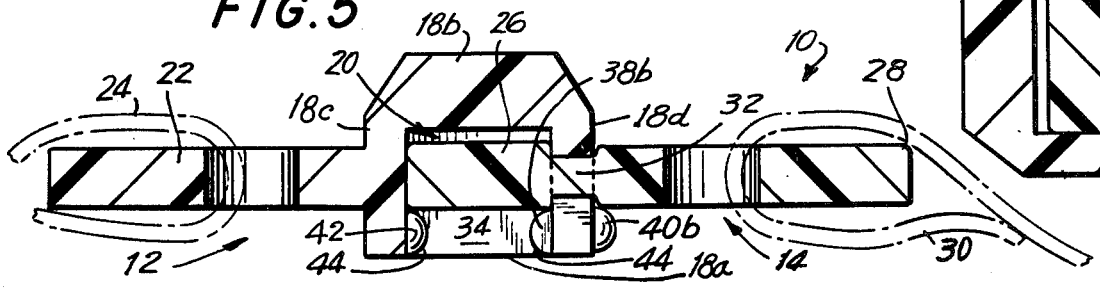
FIG. 5 is a cross-sectional view of the snap fastener shown in FIG. 2, taken along line 5—5, and, like FIG. 4, showing the manner in which the tab of the male member is maintained within the cavity of the female member, and showing the manner in which the protuberances at the fenestration, shown both in FIGS. 4 and 5, provide positional stability for the two engaged members.

The male member 14 is provided with an insert portion 26 which in generally in the nature of a flat tab and which is configurated and dimensioned to be receivable within the cavity 20 with relatively little clearance, as best shown in FIGS. 4 and 5. As with the female member 12, the male member 14 is provided with suitable connecting means, such as the eyelet loop 28 which is similarly adapted to be connected to the other of the associated parts to be joined 30. The eyelet or loop 28 is connected to the insert portion or tab 26 by means of a neck portion 32 having a height less than the height of the tab 26, for reasons which will be described hereafter.

Provided in the face wall 18*a* is a fenestration or face opening 34 which exposes the interior of the cavity 20 and provides access thereinto. Additionally, in the embodiment 10 being described, the side wall 18*d* is provided with a side aperture or cut-out 36 whose periphery is interrupted so as to cause the aperture 36 to open in the same general direction as the fenestration 34. The aperture 36 is provided on the side of the wall 18*d* which adjoins the face wall 18*a*, the aperture 36 being dimensioned to receive an associated neck portion 32 substantially simultaneously with the passage of the tab 26 through the fenestration 34 into the housing 18.

The male member 14 may also be integrally formed, such as by injection molding, although both the male and the female members 14, 12 respectively may be formed by any conventional means other than by injection molding.

The fastener 10 includes retaining means which in this embodiment comprises a pair of inwardly projecting protuberances 38*a* and 38*b* in the region of the fenestration 34 to serve as constrictions of the fenestration area at the entry point to the interior of the housing 18 to prevent free passage of the tab 26 therethrough. In this manner, the tab 26 may be snapped into the interior of the housing 18 by forcing the tab through the fenestration 34 against the action of the protuberances 38*a* and 38*b*. As suggested above, the protuberances or retaining means need only provide a local constriction at the fenestration area, and need not take any special shape or form. The protuberances or nipples 38*a* and 38*b* in effect provide an interference fit when the tab 26 is forced through the fenestration 34. While it is theoretically possible to utilize only one one protuberance, advantageously a plurality of protuberances are provided and preferably spaced apart about the periphery of the fenestration 34 to provide an interrupted retaining means. It should be evident that at least the housing 18, the tab 26 or the protuberances 38*a*, and 38*b* should be resilient to permit the tab 26 to be forced into the cavity 20. However, in the presently preferred embodiment the male and female members 14, 12 are integrally molded from a resiliently yieldable material, so that the housing 18, the tab 26 and the protuberances 38*a* and 38*b* are each resilient. For this reason, insertion of the tab 26 into the housing 18 results from a deformation of at least one or all of these cooperating elements.

According to one feature of the present invention, the housing 18 and the loop or eyelet 22 are generally in a common plane. Similarly, the tab 26, the neck portion 32 and the loop or eyelet 28 are similarly in a common plane. The provision of the aperture 36 in the side wall 18*d* permits the male and female members 14, 12 respectively to be generally co-planar upon insertion of the tab 26 into the housing 18 and the positioning of the neck portion 32 in the aperture 36.

The length of the neck portion 32 is approximately equal to the thickness of the side wall 18*d* in which the aperture 36 is formed. In this manner, at least a portion of the side wall 18*d* is received between the tab 26 and the eyelet or loop 28 with little clearance, as best shown in FIG. 5. With this arrangement, the retaining means advantageously includes at least one resilient protuberance projecting on the outer or exterior side of the side wall 18*d* projecting in a direction away from the fenestration 34 and in the direction of the eyelet or loop 28. In the embodiment, two such additional protuberances 40*a* and 40*b* are formed on the outside surface of the side wall 18*d* to provide an interference fit between the side wall 18*d* and the eyelet or loop 28 in order to resist initial insertion of the neck portion 32 into the aperture 36 and resist removal of the neck portion 32 from the aperture 36 when the socket portion 16 and the insert portion 26 are engaged. In the presently preferred embodiment, both inwardly directed nipples or protuberances 38*a* and 38*b* as well as outwardly directed protuberances or nipples 40*a*, 40*b*, are provided. Where two outwardly projecting protuberances 40*a*, 40*b* are used, these are advantageously at opposing peripheral portions of the aperture 36 as shown in the Figures. Similarly, where two protuberances 38*a*, 38*b* are provided, these are similarly disposed at opposing peripheral portions of the aperture 36. Where only two protuberances are provided, these may be disposed on opposite sides of the side wall 18*d*, such as, for example, the protuberances 38*a* and 40*a*.

While the housing of the fastener 10 includes a rear wall 18*b*, such a wall is not a critical feature of the invention, as will become evident hereafter. According to the broader aspect of the invention, the socket portion merely includes a peripheral wall, such as the walls 18*c*–18*f* with the embodiment shown in FIG. 1. For example, the rear wall 18*b* may be omitted as long as some type of abutment means, such as suitable shoulders are provided in its place so as to retain the tab 26 within the housing 18. In effect, such shoulders can still define an effective cavity or internal space adapted to receive the tab 26 with little clearance and for limited movement therein. In the fastener 10, the rear wall 18*b* serves as much shoulders or abutment means on the side of the housing 18 opposite to the fenestration 34. In other respects, the operation of the fastener would not be changed, and the tab may still be snapped into the interior of the housing as defined by the peripheral wall thereof to occupy the internal space by forcing the insert portion or tab 26 through the fenestration 34 against the action of the protuberances.

As noted above, a plurality of protuberances may be provided and spaced from each other about the fenestration 34. It is advantageous to utilize at least two protuberances which are disposed on substantially opposite sides of the fenestration 34 to prevent excessive play of the tab 26 within the socket portion 16. In the fastener 10, three protuberances 38*a*, 38*b* and 42 are provided, two of these protuberances 38*a*, 38*b* are spaced from each other on the internal surface of the side wall 18*d* while the third protuberance 42 is provided on the internal surface of the side wall 18*c* and aligned substantially midway between the two protuberances 38*a* and 38*b* so that the three protuberances under discussion are arranged to outline a triangle. In this manner, the insert portion 26 is retained by the three protuberances 38*a*, 38*b* and 42 at three triangulated contact points to provide improved positional and retention stability.

The specific dimensions of the above-described protuberances or nipples are not critical, as long as they perform their intended functions of permitting the socket and insert portions to be snappingly and releasably connected to each other. The actual dimensions of such protuberances will, at least in part, depend on the shape of the protuberances, as well as the material out of which they are made. By way of example only, it has been found that for a fastener of the type shown in FIG. 1 which has a housing 18 with a height of approximately 0.58 inches and a width of approximately 0.2 inches, and with a peripheral wall having a thickness of approximately 0.04 inches, the protuberances may project into the fenestration of project approximately 0.12 inches outwardly thereof. The size and strength of these protuberances will also be a function of the loads applied to the fastener and the manner in which they are applied since this will effect to a great extent the actual stresses applied to the protuberances. The important characteristics of the protuberances is that they provide an interference fit to the tab 26 and permit the tab to be inserted into the cavity by way of a snap-fitting connection.

In accordance with another feature of the present invention, the retaining means or above-described protuberances are configurated to be self-aligning by providing guide surfaces 44 which face outwardly of the socket portion 16 adapted to contact the tab 26 upon initial abutment of the latter against the former. In this manner, initial contact between the tab 26 and the protuberances 28*a*, 38*b* and 42 aligns the tab 26 with the fenestration 34 and permits the tab 26 to be snappingly urged into the socket portion 16. This feature is particularly advantageous when the fastener is utilized on articles of clothing which are inaccessible or inconvenient to reach. In addition to the cylindrical guide surfaces 44, formed by the protuberances 38*a*, 38*b*, and the spherical guide surface 44 on the protuberance 42, other guide surfaces may be utilized such as bevel or inclined surfaces. In this connection, it will be noted that the protuberances having these guide surfaces have additional guide means facing inwardly of the cavity or the fenestration 34, so that the same or similar guide surfaces are provided for the engaging portions of the male member 14 to permit removal of the tab 26 from the socket portion 16.

Figure 2:
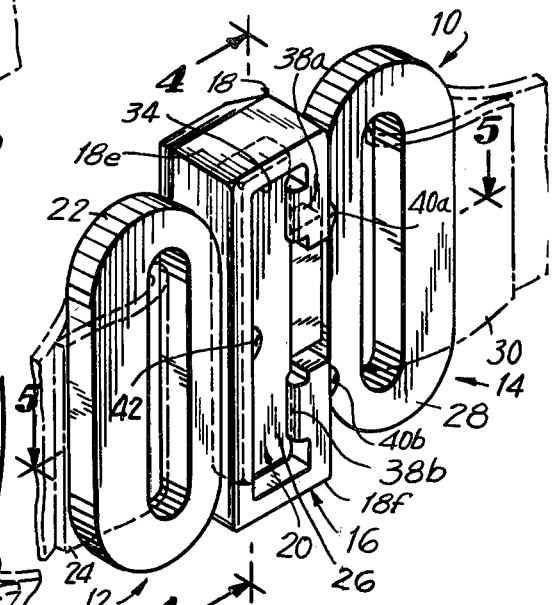
FIG. 2 is a perspective view similar to FIG. 1, but showing the male and female members of the snap fastener in the connected or joined condition.
Figure 3:
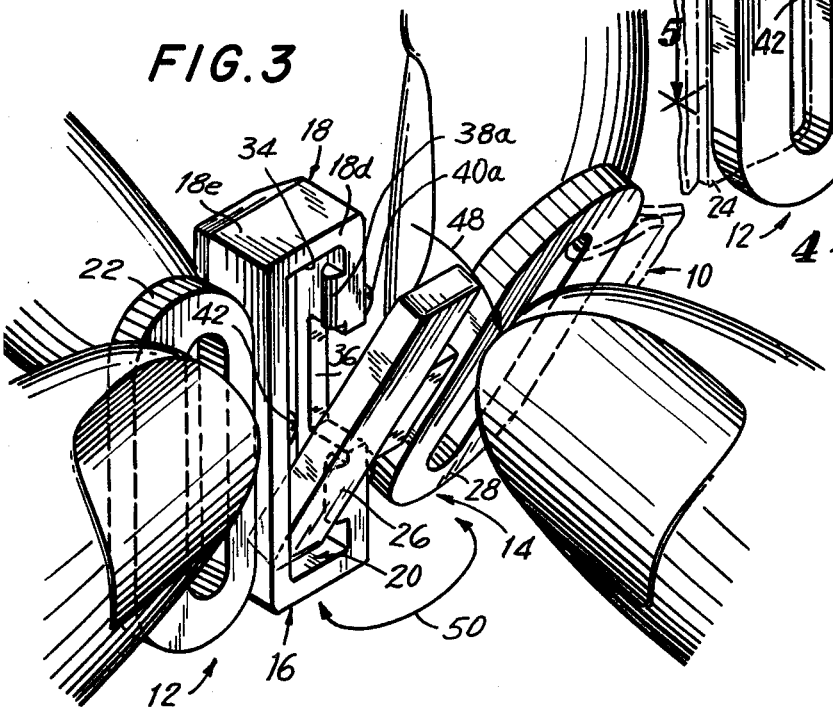
FIG. 3 is similar to FIGS. 1 and 2, and showing the manner in which the connecting means attached to the male and female members may be manually gripped to separate the male and female members without applying excessive stresses to the parts to which they are connected, and illustrating one possible relative movement of the male and female members to effect separation therebetween.

With the construction of the fastener 10 as above-described, it should be evident, referring to FIG. 1, that the insert portion 26 and the socket portion 16 can be snapped into engagement while maintaining these portions in substantially parallel planes throughout the joining operation, as suggested by the arrow 46. Thus, while the female and male members 12, 14 may be maintained in substantially parallel planes both before and after they are joined, they are moved along a direction substantially normal to those planes in order to force the tab 26 into the cavity 20 against the action of the various protuberances described. Once engaged, as shown in FIG. 2, the male and female members 14, 12 may be separated by pulling the tab 26 out of the socket portion 16, against the action of the protuberances which tend to maintain the tab 26 locked therein. It has been found that the user need exert smaller forces to effect a separation if the make and female members are angularly rotated one with respect to the other out of their common planes as suggested by the arrows 48 and 50 in FIG. 3. By rotating the male and female members 14, 12 as suggested, the retaining forces created by one or more of the protuberances are initially overcome and this reduces the overall force needed to separate the members. An attempt to separate the female and male members 12, 14 by moving the same in transverse directions, or in directions opposite to the direction indicated by the arrow 46, requires a force to overcome the action of all of the protuberances simultaneously and this force is considerably greater. It is the combined action of all the protuberances which assures positional stability and which prevents inadvertent separation of the male and female members. The types of actions suggested in FIG. 3 for disconnecting the male and female members are generally those which are unlikely to be experienced in day to day uses of the fasteners. Accordingly, it is highly unlikely that the make and female members will inadvertently separate as has been common with some prior art fasteners. Also, because separation of the male and female members requires at least some movement generally transverse to the plane of the fastener 10, mere pulling forces in the plane thereof cannot inadvertently separate these members as with the separable fasteners described in the Background of the Invention. The pulling forces which the fastener 10 is capable of withstanding is only limited by the strength of the material from which the fastener is made.

Figure 6:
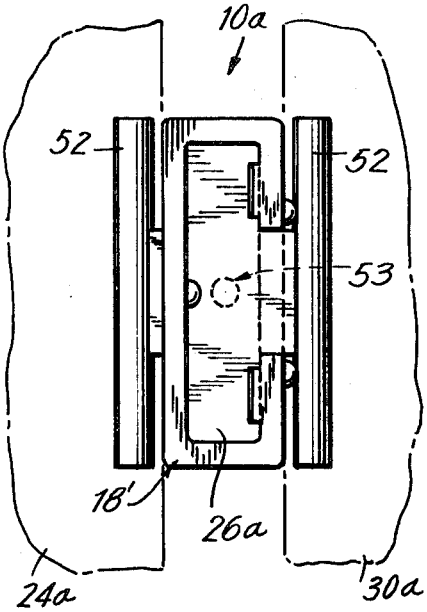
FIG. 6 is a front elevational view of another embodiment of the snap fastener in accordance with the present invention, wherein stiffening bars are utilized as connecting means attached to the socket and insert portions, as opposed to the loops or eyelets shown on the embodiment of FIG. 1, and further showing in dashed outline an additional connecting means which cooperates with the insert portion and with that wall of the socket portion housing opposite to the fenestration.

Referring to FIG. 6, a further embodiment 10*a* is shown, which is generally similar to the embodiment 10, except that the eyelets of loops 22, 28 are replaced by substantially rigid bars 52, which may be used as stiffening members and used in conjunction with, for example, belts, bow-ties or the like. The fastener 10*a* is also provided with additional connecting means 53 which may include a pin extending normally to the tab 26*a* in the direction of the rear wall 18*b* which is provided with a hole or opening therein. The free end of the pin is advantageously enlarged so as to be snappingly receivable within the hole provided in the rear wall 18*b*. This construction, while not shown in FIG. 6, should be evident from an examination of a similar version of this connection means in FIG. 8.

Figure 7:
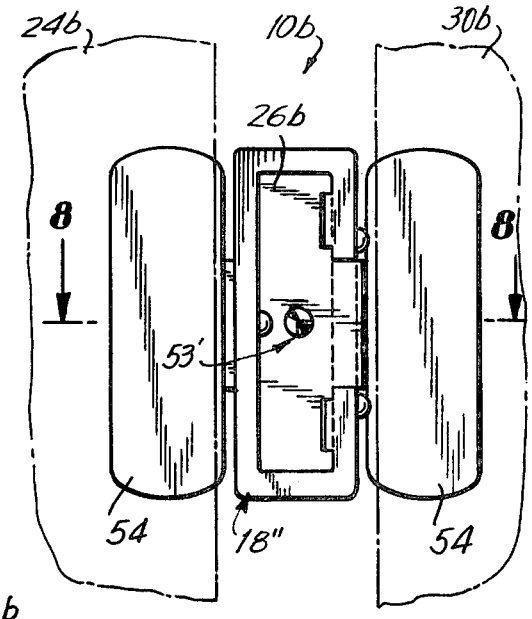
FIG. 7 is similar to FIG. 6, except that flat sewing tabs are used in place of bars for connecting means, and also showing a modified embodiment of the additional connecting means shown in FIG. 6.
Figure 8:
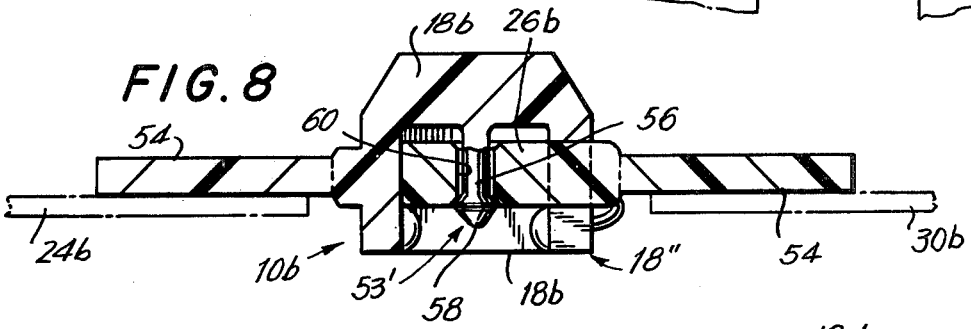
FIG. 8 is an enlarged cross-sectional view of the snap fastener shown in FIG. 7, taken along line 8—8.

In FIG. 7, a further embodiment of the snap fastener 10*b* is shown, wherein the connecting means attached to the tab 26*b* as well as to the housing 18*b* are in the nature of substantially flat and thin sewing tabs 54 which may be readily pierced by the needle of a sewing machine or the like. With the fastener 10*b*, an additional connecting means 53' is also provided, the details of which are best shown in FIG. 8. The connecting means 53' includes a pin 56 which projects from the rear wall 18*b* inwardly into the interior of the housing 18*b* in the direction of the fenestration. A hole 60 is provided in the tab 26*b* aligned with the pin 56 when the tab is received within the housing 18". The hole 60 is dimensioned to provide an interference or snap fit with the enlarged head portion 58. In this manner, the tab 26*b* may be snapped into the housing 18" by forcing the enlarged head portion 58 through the hole 60 in the tab, as well as overcoming the frictional forces produced by the other above-discussed protuberances in and about the periphery of the fenestration.

Figure 9:
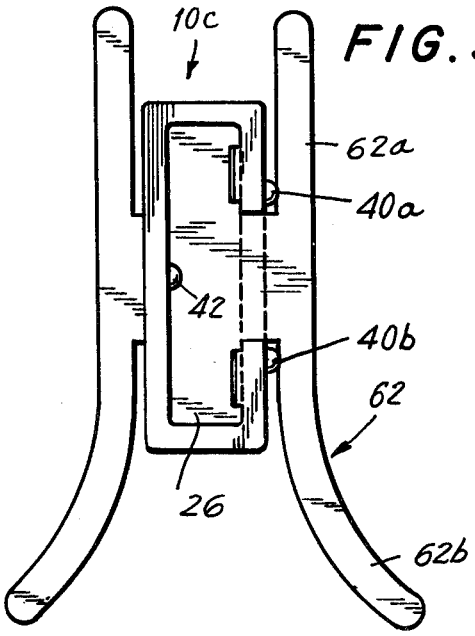
FIG. 9 is similar to the embodiment as shown in FIGS. 1–5, except that stays or stiffening portions particularly suitable for use on brassieres are utilized in place of the loops or eyelets.

In FIG. 9, a different embodiment of the fastener 10*c* is shown, wherein the same basic fastener construction is used as described above, except that the connecting means for connecting to the parts to be joined are in the nature of stays or stiffening portions 62 including a straight bar portion 62*a* and a curved portion 62*b*. Stays 62 of the type shown are particularly suitable for use with brassieres since they conform with the shapes of the cups to which they are attached. Such stays and the manner in which they are used are shown and discussed in U.S. Pat. No. 3,200,464.

The connecting means attached to the socket portions and the insert portions are advantageously made from a relatively stiff material that can be gripped and which can be used to apply separating forces to the engaged members of the fastener, without transmitting excessive stresses to the parts to which the connecting means are attached. Advantageously, as suggested above, the connecting means are, in the presently preferred embodiments, integrally formed with the respective portions of the fastener. Clearly, however, the connecting means can be joined to the fastener portions by any other suitable or conventional means, including adhesive, or other mechanical fastening means.

Figure 10:
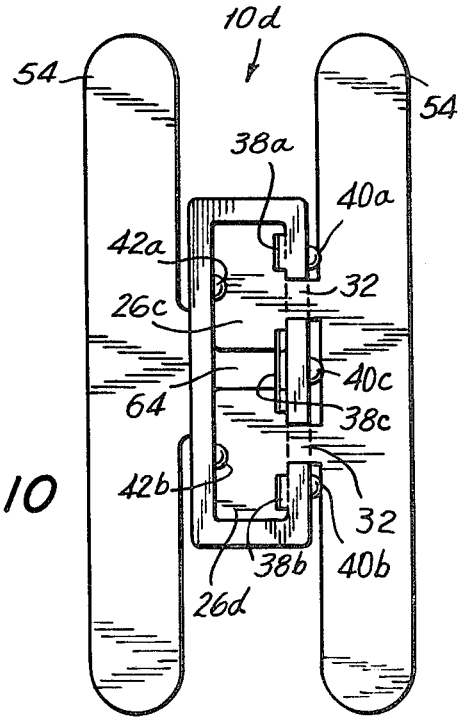
FIG. 10 is a front elevational view of a snap fastener generally similar to that shown in FIG. 7, except that in place of a single insert portion or tab on the male member, there are provided two similar and spaced insert portions which are generally receivable within a single cavity or socket portion of the female member.

Referring to FIG. 10, the fastener 10*d* illustrates that more than one single tab may be used in conjunction with one socket portion. Here, the insert portion of the male member 14 includes two generally co-planar tabs 26*c* and 26*d* connected to the planar sewing tab 54. As with the other embodiments, the socket portion of the female member 12 has an elongate fenestration of the type shown in FIG. 10, or two separate and distinct substantially co-planar fenestrations. The two tabs 26*c* and 26*d* are dimensioned and configurated to be receivable within associated ones of the cavities of the socket portions, and retaining means being associated with an enlarged fenestration or two separate fenestrations for providing a snap or interference fit during insertion and removal of the tabs 26*c* and 26*d* from the socket portions. The fastener 10*d* utilizes one generally elongate housing having one socket portion and one fenestration. However, three inwardly directed protuberances 38*a–38c* are provided on one side of the side wall 18*d*, while three protuberances 40*a–40c* are provided on the other side thereof. Now, two protuberances 42*a* and 42*b* are provided so that the protuberances projecting inwardly of the housing provide a triangulated set of contact points for each tab of the type described above and as shown, for example, in FIG. 1. Where two separate tabs are used, two neck portions 32 connect these tabs to the connecting means, such as the sewing tab 54. The length of the protuberance 38*c* is selected to be sufficiently long to bridge the gap or space 64 between the tabs or inserts 26*c*, 26*d*.

The fastener 10*e* shown in FIG. 11 illustrates how the principle of the present can ben utilized in a fastener provided with two socket portions or cavities 20*a* and 20*b*. The fastener 10*e* is generally similar to the fastener 10*d* shown in FIG. 10, except that the cavities 20*a* and 20*b* are not in communication The cavities 20*a* and 20*b* and the insert portions 26*e*, 26*f* are generally cylindrical and have a circular cross-section, and not rectangular as in the case of the above-described embodiment. The protuberances 40*a* and 40*b* on the fastener 10*e* serve the same function as above-described. In place of the inwardly projecting protuberances 38*a*, 38*b* and 42, another possible arrangement of protuberances for use with circular socket and insert portions is to use two opposing protuberances 66 as shown.

Referring to FIG. 12, there is shown a still further embodiment 10*f*, wherein the female member 12*a* is provided with two socket portions adjacently disposed as shown. Two separate male members are provided each of which is similar to the male member 14 described in connection with the embodiment 10. Each male member is provided with its own connecting means, shown in FIG. 12 to be in the nature of loops or eyelets 28, and a separate insert which is receivable within one of the associated socket portions of the female member 12*a*. The fastener 10*f* is particularly suitable for use with a brassiere utilized for breast-feeding mothers. The female member 12*a* is joined by conventional means to a central strap or member disposed between the two cups of the brassiere by means of the connecting tab 68 or the holes 70. The portion of the brassiere to which the female member 12*a* is connected remains fixed during use. Each of the male members is connected, by means of the loops 28 or other conventional means to the cups of the brassiere. In this manner, each cup may be separately disconnected from the central fixed strap and moved to the side of the user. Each cup may, therefore, be selectively removed to substantially facilitate the use of such breast-feeding brassiere. The operation of the fastener 10*f* is substantially the same as that described in connection with the fastener 10, each socket portion and associated male member or insert portion, each individually operating in the same manner as the operation of the fastener 10. Each half of the fastener 10*f* is provided with its own retaining means at each fenestration for providing a snap or interference fit during insertion and removal of the inserts from their associated sockets. For the brassiere use of the fastener 10*f* described above, the connector 68, which may be in the nature of a sewing tab, is disposed at the rear wall of the housing and opposite to the common plane in which the fenestrations providing access to the two socket portions are disposed. Also, for this application, the loops 28 or other suitable connecting means for the male members are disposed on opposite sides of the female member 12*a* when the two male members are engaged with the female member as shown in FIG. 12.

Referring to FIG. 13, a fastener 10*g* is shown which is generally similar to the fastener 10*f*, except that the loops 28 are replaced by sewing tabs 54, and instead of using a connector tab 68, the housing of the female member is sewn directly to the part on which the fastener is mounted, such as by means of stitching 72.

In FIG. 14, a still further version of the present invention is shown which provides for adjustability. The fastener 10*h* includes a generally elongate member of a substantially solid elongate bar 74 provided on one side thereof with a connector 76 which is in the nature of a flat and thin sewing tab or portion. The sewing tab 76 may be integrally formed with the elongate member 74 or may be attached thereto by any conventional means, such as by use of adhesive or the like. Provided in spaced relation along the lengths of the elongate member 74 are a plurality of holes 78, the openings of the holes 78 facing in a direction away from the sewing strip or tab 76 defining fenestrations and are provided with inwardly projecting protuberances 80 provided at the fenestrations to serve as obstructions of the areas of the fenestrations. The male member 82 is provided with a sewing tab 86, for example, from which extends a projection 84 which is generally cylindrical and dimensioned to be received within the holes 78 with little clearance. The protuberances or nipples 80 serve as local constrictions of the areas of the fenestrations to prevent free passage of the projections 84 therethrough. In this manner, the projection 84 may be snapped into the interior of any one of the holes 78 by forcing the same through a fenestration against the action of the associated protuberances 80. With this arrangement, the projection 84 may be received within any one of the holes 78, so that the associated parts to which the male and female members are connected may be joined to each other at different relative positions.

While the female member of the fastener 10*h* is shown to be provided with six holes 78 generally aligned along a straight line, it should be evident that the female member may be provided with only one such hole or as many holes as may be desired or necessary. In fact, the elongate strip or member 74 may be continuously formed, and subsequently cut to the desired length or to provide the desired number of holes 78. One specific application of the adjustable snap fastener **10*h* will be described below with reference to FIGS. 18–20**.

Referring to FIGS. 15 and 16, there is shown yet a further embodiment of the present invention and is designated by the reference numeral **10*i*. While the fastener 10*i* is shown to include both a hole 78 as well as a projection 84, it should be evident that a fastener similar to 10*i* can be formed wherein the elongate member attached to the connecting means or loop 88 bears only a projection 84 or a hole 78. In the latter case, the fastener is similar to the other ones discussed above in that both a female and male member must be used to form the fastener. However, with the fastener 10*i*, this is in the nature of a universal member which serves both as the male and female member of the fastener. As best shown in FIG. 16, two universal members of the type shown in FIG. 15 may be used to form a fastener, the projection of one member being receivable within the hole 78 of the other member, and vice versa. With the use of a universal member of this type, it is not necessary to injection mold or otherwise produce two separate or different types of fastening members. Yet, the fastener 10*i*** provides many of the same advantages discussed above in connection with the other described fastener embodiments.

Figure 17:
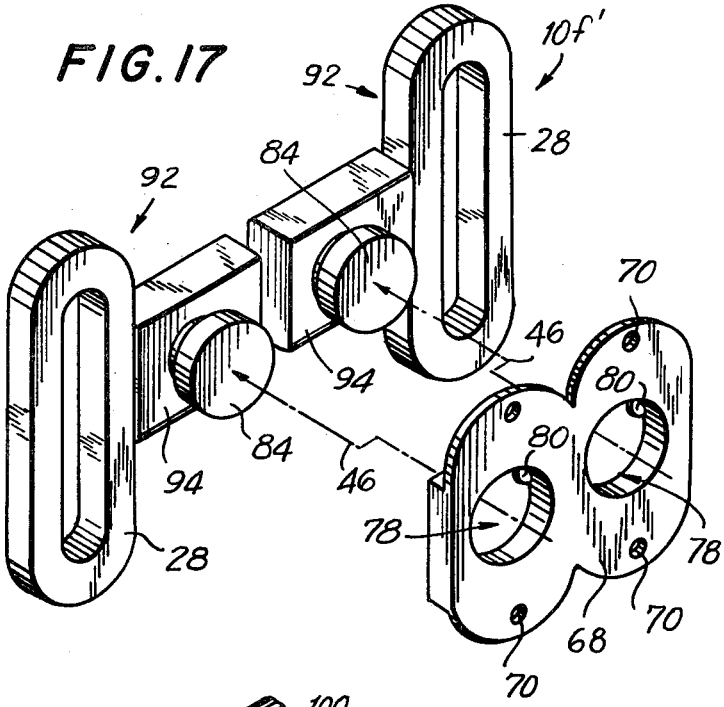
FIG. 17 is an exploded perspective view of an embodiment generally similar to that shown in FIG. 12, except that the socket and insert portions are generally similar to the type shown in FIG. 15.

In FIG. 17, a fastener **10*f'* is shown which is similar in many respects to the fastener 10*f* as shown in FIG. 12 and is also suitable for use with brassieres used by breast-feeding mothers. However, the female member is provided with through holes 78 and protuberances 80 of the type discussed in connection with FIGS. 14–16. Each of the male members 92 is provided with a bar 94 from which extends the projection 84. The operation of the fastener 10*f'* is otherwise similar to that of the fastener 10*f***.

As suggested above, the snap fasteners of the present invention have far ranging uses and may be used in many different and varied applications. Among these are uses on garments of various types, including shirts, pants, and belts. The fact that the male and female members normally merge into a common plane during engagement with most of the described embodiments, makes the snap fasteners of the present invention particularly suitable for use on under garments, such as brassieres, since the fasteners generally defined have substantially flat and smooth surfaces which are comfortable when abutting against the body of the wearer. The generally co-planar or in-line relationship of the various male and female connector portions during locking engagement therebetween avoids irritation to the skin of the wearer and discomfort, as is common with some other presently used fasteners.

Figure 18:
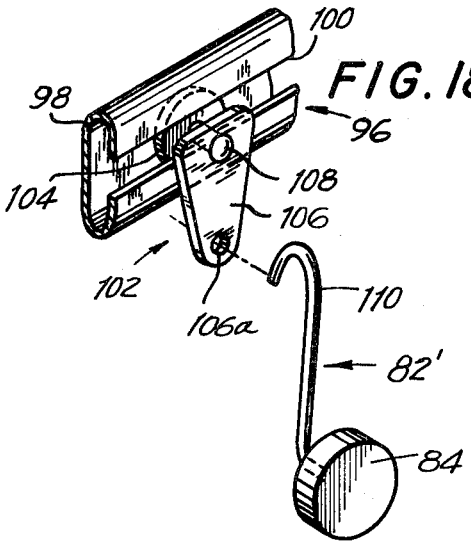
FIG. 18 is a fragmented perspective veiw of a curtain rod assembly including a movable element, and a male connector portion in accordance with still another embodiment of the present invention which is provided with a hook or other suitable means for attachment to the movable element of the curtain rod assembly.
Figure 19:
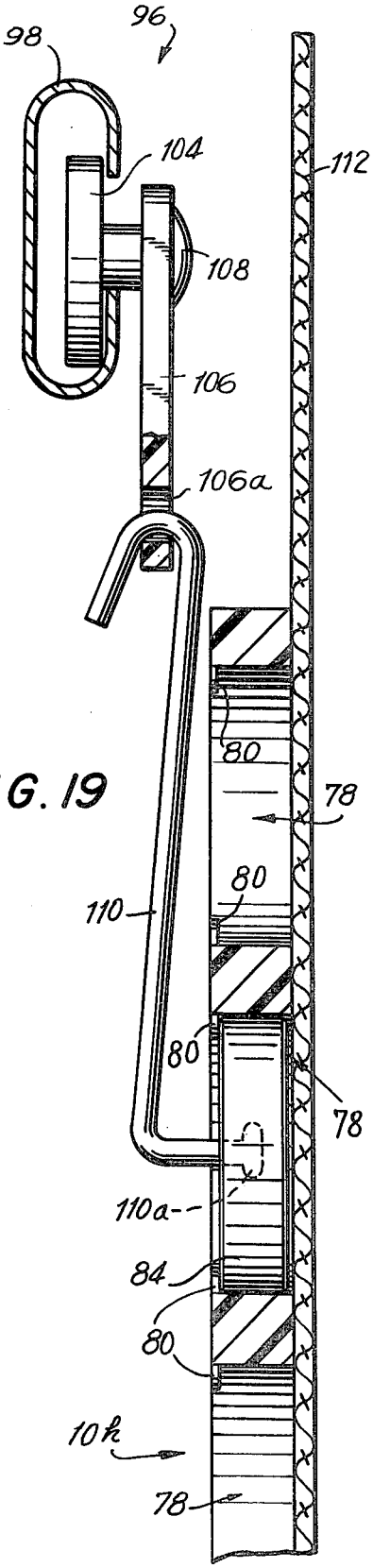
FIG. 19 is an enlarged side elevational view of the curtain rod assembly shown in FIG. 18, and further showing the manner in which the male connector member is engaged to the curtain rod movable element and joined with a female member generally of the type shown in FIG. 14 to provide adjustability of the relative positions of the curtain to be hung and the curtain rod.
Figure 20:
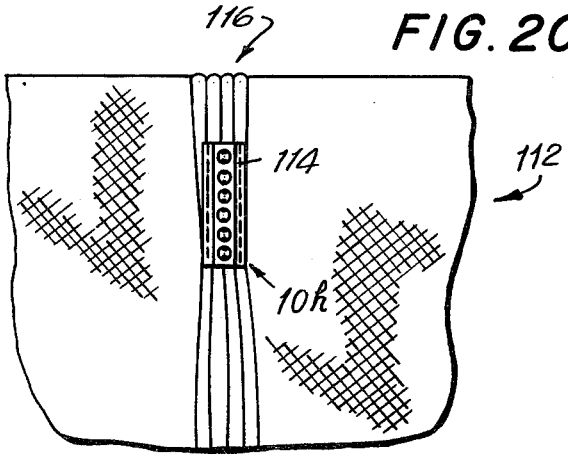
FIG. 20 is a rear elevational view of a portion of a curtain, showing the manner in which the female member of the snap fastener shown in FIG. 14 is mounted on the curtain, such as at the pleated portion thereof.

By way of example only, there is disclosed one other application or use of the snap fastener of the present invention, namely the snap fastener **10*h* shown in FIG. 14. Referring to FIGS. 18–20, there is shown a curtain rod assembly 96 which includes a generally C-shaped channel rod 98 provided with an elongate open slot 100 on one side thereof. Mounted for movement along the channel 98 is a movable element 102 which includes a disc or wheel 104 connected to a carrier member 106 by means of a pin 108. The carrier member 106 is provided with a hole 106*a*** adapted to receive a hook of the type commonly used for hanging curtains on such rods.

In FIGS. 18 and 19, an insert portion 84 similar to the projections 84 shown in FIGS. 14–16 is shown connected to a wire hook 110 adapted to be supported by the carrier member 106. The end of the wire remote from the hook end is advantageously provided with an enlarged end **110*a* around which is molded the male member or insert portion 84. In use, the female member of the connector 10*h* is initially sewn to the curtain 112 by any suitable means, such as sewing stitches 114 so that the holes on the female member are spaced from each other along a substantially vertical direction when the curtain is hung The wire hook is mounted on a suitable carrier 106 and the male member or insert portion 84 is forced into one of the sockets or holes 84 of the female member. This adjustability allows the curtain 112 to be raised ot lowered to bring either the upper or lower edges of the curtain 112 to any desired position. This also permits the curtain to be readjusted in the event that the curtain 112** is shortened or shrinks subsequent to cleaning. Numerous other uses for the various snap fasteners disclosed in this application should become evident to those skilled in the art.

It is to be understood that the foregoing description of the various embodiments illustrated herein is exemplary only and various modifications to the embodiments shown herein may be made without departing from the spirit and scope of the invention.

We claim:

1. A fastener for releasably joining two associated parts to each other, comprising a female member having a first connecting means for connecting said female member to one of the associated parts, and having a socket portion; a male member having a second connecting means for connecting said male member to the other one of the associated parts and having an insert portion, said insert portion being dimensioned and configurated to be removably receivable within said socket portion with little relative clearance, said first and second connecting means being securely attached to the respective ones of said portions and being adapted to be gripped to disengage said portions without applying excessive stresses to the associated parts, said socket portion forming a substantially hollow housing having an aperture in a side wall and having fenestration means in a face wall of said housing for exposing the interior thereof, and said insert portion comprising a tab dimensioned and configurated to substantially correspond to the configuration and dimension of the interior of said hollow housing so as to be receivable therein by passage through said fenestration means, at least one of said portions being provided with retaining means in the form of a plurality of protuberances, some of which are on one side of said side wall projecting inwardly of said fenestration means and on the other side of said side wall projecting in a direction away from said fenestration means and in a direction of said second connecting means, so that said retaining means releasably retaining the other of said portions during engagement therebetween of said socket and insert portions, said insert portion being snappingly receivable into said socket portion by deforming at least one of said portions and said retaining means.

2. A fastener as defined in claim 1, wherein the interior of said housing defines a substantially rectangular cavity, and said tab is generally rectangular in shape.

3. A fastener as defined in claim 1, wherein said retaining means comprises protuberances in the region of said fenestration means to serve as a constriction of said fenestration means area at the entry point to the interior of said housing to prevent free passage of said tab therethrough, whereby said tab may be snapped into the interior of said housing by forcing said tab through said fenestration means against the action of said protuberances.

4. A fastener as defined in claim 1, wherein said plurality of protuberances are spaced about the periphery of said fenestration means to provide an interrupted retaining means.

5. A fastener as defined in claim 3, wherein said protuberances comprise each a resilient nipple projecting inwardly from a peripheral portion of said fenestration means.

6. A fastener as defined in claim 1, wherein said male and female members are made from an elastically yieldable material.

7. A fastener as defined in claim 1, wherein said tab is connected to said second connecting means by means of a neck portion, and wherein said housing is provided with an aperture in a side wall thereof adjoining said face wall and opening in the direction of said fenestration means, said aperture being dimensioned to receive an associated neck portion substantially simultaneously with passage of said tab through said fenestration means into said housing.

8. A fastener as defined in claim 7, wherein said aperture and said first connecting means are associated with opposing walls of said housing.

9. A fastener as defined in claim 7, wherein said housing and said first connecting means are generally co-planar; said tab, said neck portion and said second connecting means are generally co-planar, whereby said male and female members are generally co-planar upon full insertion of said tab into said housing and said neck portion into said aperture.

10. A fastener as defined in claim 7, wherein the length of said neck portion is approximately equal to the thickness of said side wall in which said aperture is formed, whereby at least a portion of said side wall is received between said tab and said second connecting means with little clearance, and said retaining means comprises resilient protuberances on one side of said side wall projecting inwardly of said fenestration means to serve as a constriction of said fenestration means area to prevent free passage of said tab therethrough by providing an interference fit therewith.

11. A fastener as defined in claim 10, wherein said retaining means comprises other resilient protuberances on the other side of said side wall projecting in a direction away from said fenestration means and in the direction of said second connecting means, said other resilient protuberances providing an interference fit between said other side of said side wall and said second connecting means to resist initial insertion of said neck portion into said aperture and resist removal of said neck portion from said aperture once said socket and insert portions are engaged.

12. A fastener as defined in claim 11, wherein two of said other resilient protuberances are provided, one on each side of the open end of said aperture.

13. A fastener as defined in claim 11, wherein two resilient protuberances are provided one on each side of the open end of said aperture.

14. A fastener as defined in claim 10, wherein two resilient protuberances are provided one on each side of the open end of said aperture.

15. A fastener as defined in claim 1, wherein said insert portion comprises at least two generally co-planar tabs connected to said second connecting means, and wherein said socket portion comprises a substantially hollow housing having at least two fenestration means in said face wall for exposing the interiors of associated cavities, said at least two tabs being joined to said second connecting means and being dimensioned and configured to be receivable within associated ones of said cavities, resilient retaining means being associated with each of said at least two fenestration means for providing a snap or interference fit during insertion and removal of said at least two tabs from the associated ones of said cavities.

16. A fastener as defined in claim 1, wherein said housing has a rear wall opposite to said face wall, and said resilient retaining means comprises a pin having an enlarged head portion projecting into said housing in the direction of said fenestration means, and a hole in said tab aligned with said pin when said tab is received within said housing, said hole being dimensioned to provide an interference or snap fit with said enlarged head portion, whereby said tab may be snapped into said housing by forcing said enlarged head portion through said hole in said tab.

17. A fastener as defined in claim 1, wherein said female member comprises two socket portions, and wherein two wall members are each provided with a second connecting means and each having an insert portion removably receivable within an associated socket portion of said female member.

18. A fastener as defined in claim 17, wherein said female member comprises a housing having two cavities forming said two socket portions, each of said cavities being defined by wall means bounding the respective cavity and accessible by an associated fenestration means, separate retaining means being provided at each fenestration means for providing a snap or interference fit during insertion and removal of said insert portions from the associated ones of said cavities.

19. A fastener as defined in claim 18, wherein said fenestration means associated with said two cavities are in a common plane and said first connecting means is provided on a wall of said housing opposite to said common plane.

20. A fastener as defined in claim 19, wherein said two second connecting means of said two male members are disposed on opposite sides of said female member when said two male members are engaged with said female member.

21. A fastener as defined in claim 1, wherein said first and second connecting means comprise at least one loop or eyelet.

22. A fastener as defined in claim 1, wherein said first and second connecting means comprise at least one substantially planar sewing tab.

23. A fastener as defined in claim 1, wherein said first and second connecting means comprise at least one elongate brassiere stiffening portion or stay.

24. A fastener as defined in claim 1, wherein said first and second connecting means comprise at least one elongate bar receivable within at least one of the associated parts.

25. A fastener as defined in claim 1, wherein said first and second connecting means are made from a relatively stiff material.

26. A fastener as defined in claim 1, wherein said connecting means are integrally formed with the respective portions.

27. A fastener as defined in claim 1, wherein said resilient retaining means is dimensioned and configurated to permit said insert and socket portions to be maintained in relative parallel orientations both before and subsequent to engagement.

28. A fastener as defined in claim 1, wherein said retaining means is made of a resilient or elastic material.

29. A fastener as defined in claim 1, wherein said retaining means is configurated to be self-aligning by providing guiding surfaces facing outwardly of said socket portion and adapted to contact said insert portion upon initial abutment of the latter against the former, whereby initial contact between said portions aligns the same and permits said insert portion to be snappingly urged into said socket portion.

30. A fastener as defined in claim 1, wherein said socket portion comprises a substantially hollow housing formed by peripheral wall means and having fenestration means having a configuration substantially corresponding to that of the interior of said housing as defined by said peripheral wall means for exposing said interior of said housing and providing access thereinto, said housing being provided with abutment means on the side of said housing opposite to said fenestration means for limiting movement of said insert portion within said housing; and said retaining means comprising inwardly directed protuberances provided at said fenestration means to serve as a constriction of the area of said fenestration means to prevent free passage of said insert portion therethrough, said abutment means and said at least one protuberances together with said peripheral wall means defining an internal space for receiving said insert portion with little clearance therebetween, whereby said insert portion may be snapped into the interior of said housing to occupy said internal space by forcing said insert portion through said fenestration means against the action of said at least one protuberances.

31. A fastener as defined in claim 30, wherein said protuberances are provided and spaced from each other about said fenestration means.

32. A fastener as defined in claim 31, wherein at least two protuberances are disposed on substantially opposite sides of said fenestration means to prevent excessive play of said insert portion within said socket portion.

33. A fastener as defined in claim 32, wherein three protuberances are provided, two of said protuberances being spaced from each other on one wall portion of said peripheral wall means and the third protuberance is disposed on an opposing wall portion of said peripheral wall means and on a line substantially midway between said two protuberances so that said three protuberances are arranged to define a triangle, whereby said insert portion is retained by said three protuberances at three triangulated contact points to provide improved positional and retention stability.

34. A fastener as defined in claim 1, wherein said socket portion comprises a first generally elongate member extending from said first connecting means and formed with at least one hole, one open end of said hole defining fenestration means, and said insert portion comprises a second generally elongated member extending from said second connecting means and formed with a projection extending from said second elongate member and configurated and dimensioned to be receivable within said hole, said retaining means comprising inwardly directed protuberances provided at said fenestration means to serve as a constriction of the area of said fenestration means to prevent free passage of said projection therethrough, whereby said projection may be snapped into the interior of said hole by forcing the same through said fenestration means against the action of said at least one protuberances.

35. A fastener as defined in claim 34, wherein a plurality of spaced holes are provided along said first elongate member to permit said projection to be received within any one of said holes, whereby said associated parts may be joined to each other at different relative portions to each other.

36. A fastener as defined in claim 34, in combination with a curtain rod assembly having movable elements, wherein said first connecting means are adapted to be attached to a curtain to be hung on the curtain rod, and wherein said second connecting means are adapted to be attached to said movable elements, whereby the curtain can be releasably suspended from the curtain rod.

37. A fastener as defined in claim 34, wherein each elongate member includes a hole and a projection, the associated holes and projections on said first and second elongate members being aligned with each other to permit all associated holes and projections to be simultaneously engaged with each other.

38. A fastener as defined in claim 37, wherein said first and second elongate members are identical and interchangeable whereby only one construction of said elongate members is required, and any two elongate members may be used to form a fastener.

* * * * *